United States Patent [19]

Woldring

[11] 4,017,761

[45] Apr. 12, 1977

[54] ELECTRIC DEVICE FOR STARTING AND SUPPLYING A GAS-AND/OR VAPOR DISCHARGE LAMP

[75] Inventor: Leonard Woldring, Eindhoven, Netherlands

[73] Assignee: U.S. Philips Corporation, New York, N.Y.

[22] Filed: Nov. 25, 1975

[21] Appl. No.: 635,054

[30] Foreign Application Priority Data

Dec. 5, 1974 Netherlands ..... 7415839

[52] U.S. Cl. ..... 315/99; 315/103; 315/106; 315/244; 315/276; 315/283; 315/289; 315/DIG. 5

[51] Int. Cl.[2] ..... H05B 41/23

[58] Field of Search ..... 315/94, 99, 103, 105, 315/106, 107, 244, 254, 276, 283, 289, DIG. 2, DIG. 5

[56] References Cited

UNITED STATES PATENTS

| | | | |
|---|---|---|---|
| 3,701,925 | 10/1972 | Nozawa et al. | 315/DIG. 2 |
| 3,753,037 | 8/1973 | Kaneda et al. | 315/244 X |
| 3,851,209 | 11/1974 | Murakami et al. | 315/103 X |
| 3,866,088 | 2/1975 | Kaneda et al. | 315/105 |
| 3,942,069 | 3/1976 | Kaneda | 315/106 X |

*Primary Examiner*—Eugene R. LaRoche
*Attorney, Agent, or Firm*—Frank R. Trifari; Bernard Franzblau

[57] ABSTRACT

The invention relates to a capacitively stabilized discharge lamp shunted by a coil. During the starting procedure of the lamp the coil is brought into saturation so that, by means of resonance with the capacitive ballast, a high voltage is applied across the lamp to start it.

The B-H magnetization curve of the coil has been chosen so that a transition from the unsaturated condition to the saturated condition also occurs during the operating condition of the device, namely just before the lamp is extinguished during each half cycle of the a.c. supply voltage. Consequently the ratio of the r.m.s. voltage of the a.c. voltage source to the operating voltage of the lamp may be relatively small.

A resistor having a positive temperature coefficient shunts the lamp and is in series with the coil so as to limit the electric current if the lamp refuses to start.

13 Claims, 4 Drawing Figures

ELECTRIC DEVICE FOR STARTING AND SUPPLYING A GAS-AND/OR VAPOR DISCHARGE LAMP

The invention relates to an electric device for starting and supplying energy to at least one gas-and/or vapor discharge lamp, which device is provided with two input terminals intended for connection to an a.c. voltage source. Across the input terminals there is connected a series circuit of at least two coils and a capacitor. In the operating condition of the device the capacitor and one of the coils are connected in series with the lamp and the second coil is in parallel with the lamp. In the switched-on condition of the device, but with the lamp not yet started, the second coil becomes saturated and a resonant condition occurs, at that saturation owing to which the voltage across the as yet non-started, lamp exceeds the voltage of the a.c. voltage source. The second coil is brought out of saturation when the lamp is started and consequently assumes an impedance which exceeds the resistance of the started lamp.

A known device of the said type is, for example, described in Belgian Pat. No. 502,661. An advantage of that known device is that the voltage available for starting the lamp exceeds the supply voltage so that the minimum starting voltage of the lamp may be relatively large.

As a rule, after starting of the lamp, the second coil offers only disadvantages in the known device. So, during operation of the lamp the current through taht auxiliary coil reduces the efficiency of the device.

A second disadvantage of the know device is that, if no transformer windings are used through which the lamp current flows, the ratio between the r.m.s. voltage of the a.c. voltage source and the operating voltage of the discharge lamp must be relatively large to guarantee stable operation of the lamp.

It is an object of the invention to prevent or at least to mitigate the said disadvantages in a device of the type mentioned in the preamble. This is effected by efficiently using the second coil of the device, which coil shuts the lamp, not only during the starting procedure of the lamp but also during operation of the lamp.

An electric device according to the invention for starting and supplying at least one gas-and/or vapour discharge lamp, which device is provided with two input terminals intended for connection to an a.c. voltage source, said input terminals being interconnected by means of a series circuit of at least two coils and a capacitor, in the operating condition of the device the capacitor and one of the coils being connected in series with the lamp and the second coil being in parallel with the lamp, while in the switched-on condition of the device, but with the lamp not yet started, the second coil becomes saturated, and a resonant condition occuring at that saturation owing to which the voltage across the as yet non-starting lamp exceeds the voltage of the a.c. voltage source, the second coil, when the lamp is started being brought out of saturation and consequently assuming an impedance which exceeds the resistance of the started lamp, is characterized in that the second coil has a B–H curve such that for an increasing value of H the ratio B/H decreases to its 50% value at an instantaneous current $i$ through said coil which satisfies the expression $$0.5 \cdot \frac{Eb}{2fL} < i < \frac{Eb}{2fL}$$

in which : H is the magnetic field strength within the second coil;

B is the magnetic induction within that coil;

$i$ is the instantaneous electric current through the second coil (in Amperes);

$Eb$ is the r.m.s. voltage across the started lamp (in Volts);

$f$ is the frequency of the a.c. supply voltage (in Herz); and

L is the average self-induction of the second coil in its unsaturated condition.

An advantage of such a device according to the invention is that the operating voltage of the lamp may be relatively high. This is caused by the fact that the second coil, during the operating condition of the lamp, changes every half cycle of the supply from the unsaturated condition into the saturated condition and, consequently, generates a voltage peak which strongly promotes the re-starting of the lamp. The phase a relatively high operating voltage means that the ratio between the supply voltage and the operating voltage of the lamp may be relatively small.

In some devices according to the invention it furthermore appears that even for a relatively large decrease in the supply voltage the lamp still does not extinguish.

To explain the notion underlying the invention, the following should be noted. A drop in the ratio B/H of the second coil to 50% of its original (unsaturated) value must not be attained too early in a half cycle of the lamp supply, i.e., at not too small an instantaneous value of the current i through the second coil. Namely, this would result in a poor efficiency of the device. Furthermore, the drop in the ratio B/H of the second coil to 50% of its original (unsaturated) value must not be too long in coming, i.e., it should not occur at such a late moment that the instantaneous value of the current $i$ through the second coil is too large. Then, namely, the peak voltage for restarting of the lamp would come too late. The peak which promotes restarting occurs owing to the fact that when the second coil becomes saturated, the current through it strongly increases in value so that the voltage across the second coil, and consequently the voltage across the lamp parallel to it, experiences a rapid increase.

An electric device according to the invention may, for example, be used for starting and feeding a discharge lamp of the type which does not have preheatable electrodes.. This may, for example, be a high-pressure discharge lamp.

In a preferred embodiment of an electric device according to the invention which is intended for starting and supplying one low pressure mercury vapour discharge lamp which is provided with preheatable electrodes, the second coil is connected between the ends of each of the lamp electrodes which point away from the input terminals.

An advantage of this preferred embodiment is that the preheating current now also flows through the second coil. This current may be relatively large because, during starting of the lamp, the second coil has only a low impedance value.

In a further improvement of an electric device according to the said preferred embodiment, in which it is intended for connection to an a.c. voltage source of approximately 220 V r.m.s., 50 Hz, while the power of the lamp is approximately 85 Watts and it operating voltage is between 170 and 190 V, the self induction of the first coil is approximately 1 Henry and the capacitance of the capacitor is approximately 4.5 $\mu$ Farad and the average self-induction of the unsaturated second coil is approximately 60 Henry.

An advantage of this improvement is that the said 85 Watt lamp can be operated in a very simple manner from a 220 Volts AC supply.

It is conceivable that with an electric device according to the invention not only one but two or more series-connected discharge lamps can be supplied.

In a preferred embodiment of a device according to the invention which is intended for starting and supplying two or more series-connected discharge lamps, which are provided with preheatable electrodes, the second coil is formed by the primary winding and a core of a transformer, the primary winding being connected to the outer electrodes of the series arrangement of lamps, namely between the electrode-ends which point away from the input terminals, the remaining lamp electrodes being connected to one or more secondary windings of the transformer.

An advantage of this preferred embodiment is that with only one combination of a ballast coil and a ballast capacitor two or more lamps, having together a relatively high operating voltage, can be stabilized.

In a further improvement of the last said preferred embodiment, which is intended for connection to an a.c. voltage source of approximately 220 V r.m.s., 50 Hz, for starting and supplying a series arrangement of two low-pressure mercury vapour discharge lamps of about 40 Watt each, each having an operating voltage of approximately 100 V, the self-induction of the first coil is approximately 1.5 Henry, the capacitance of the capacitor approximately 3,7 $\mu$ Farad, and the average self-induction of the loaded, unsaturated transformer approximately 64 Henry.

An advantage of this preferred device is that, two standard 40 Watt low-pressure mercury vapor discharge lamps can be operated on one capacitive ballast from a normal supply of 220 Volt.

It is conceivable that the electric device is provided with a protection so that when the lamp does not start for some reason or other, a fuse is blown, for example, which reduces the current to zero.

In a further preferred embodiment of an electric device according to the invention a resistor having a positive temperature coefficient is included in the branch comprising the second coil and parallel to the lamp (lamps), which resisitor is connected in series with the second coil.

An advantage of this last preferred embodiment is that if for some reason or other the lamp does not start the prolonged current through the resistor having a positive temperature coefficient raises this resistor in temperature so that it assumes a high ohmic value. Thereby the current strength in the circuit is greatly reduced. The result is that no damage is caused to the ballast or to its environment.

The invention will be further explained with reference to the accompanying drawing in which.

Figure 1:
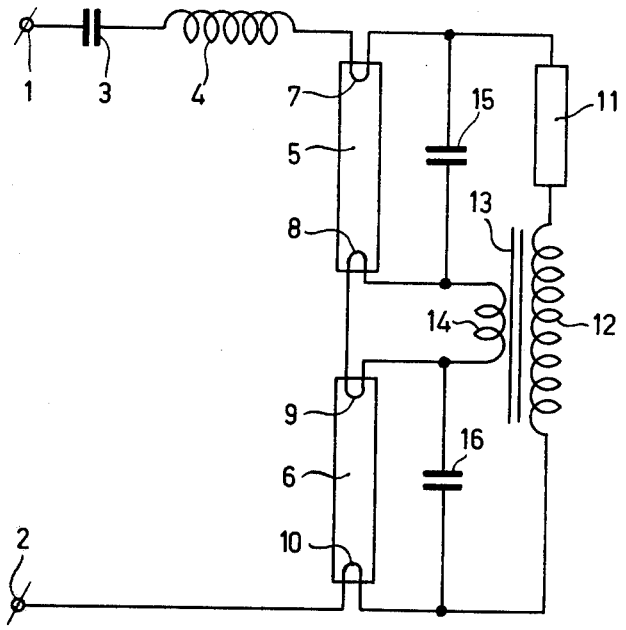
FIG. 1 shows an electric device according to the invention provided with two series-connected discharge lamps.

In FIG. 1 terminals 1 and 2 are intended for connection to an a.c. voltage source of approximately 220 V, 50 Hz. Terminal 1 is connected to a capacitor 3. The other end of this capacitor is connected to a first coil 4. The circuit elements 3 and 4 together form a capacitive ballast for stabilizing two discharge lamps in this circuit. Namely, the ballast is capacitive at the 50 Hz frequency of the supply. References 5 and 6 represent the lamps, namely two low-pressure mercury vapor discharge lamps of 40 Watt each. The operating voltage of each of the lamps is 103 V. The lamp 5 is provided with two preheatable electrodes 7 and 8. In its turn, lamp 6 is also provided with two preheatable electrodes 9 and 10. The preheatable electrode 10 of the lamp 6 is connected to terminal 2. The ends of the outer electrodes 7 and 10 which point away from the input terminals 1 and 2 are interconnected via a series circuit of a resistor 11, having a positive temperature coefficient, and a primary winding 12 of a transformer 13. Reference 14 designates a secondary winding of the transformer 13. The electrodes 8 and 9 which are connected in series are connected to the secondary winding 14 of the transformer 13. Furthermore, lamp 5 is shunted by an auxiliary capacitor 15. Finally, lamp 6 is shunted by an auxiliary capacitor 16.

Figure 3:
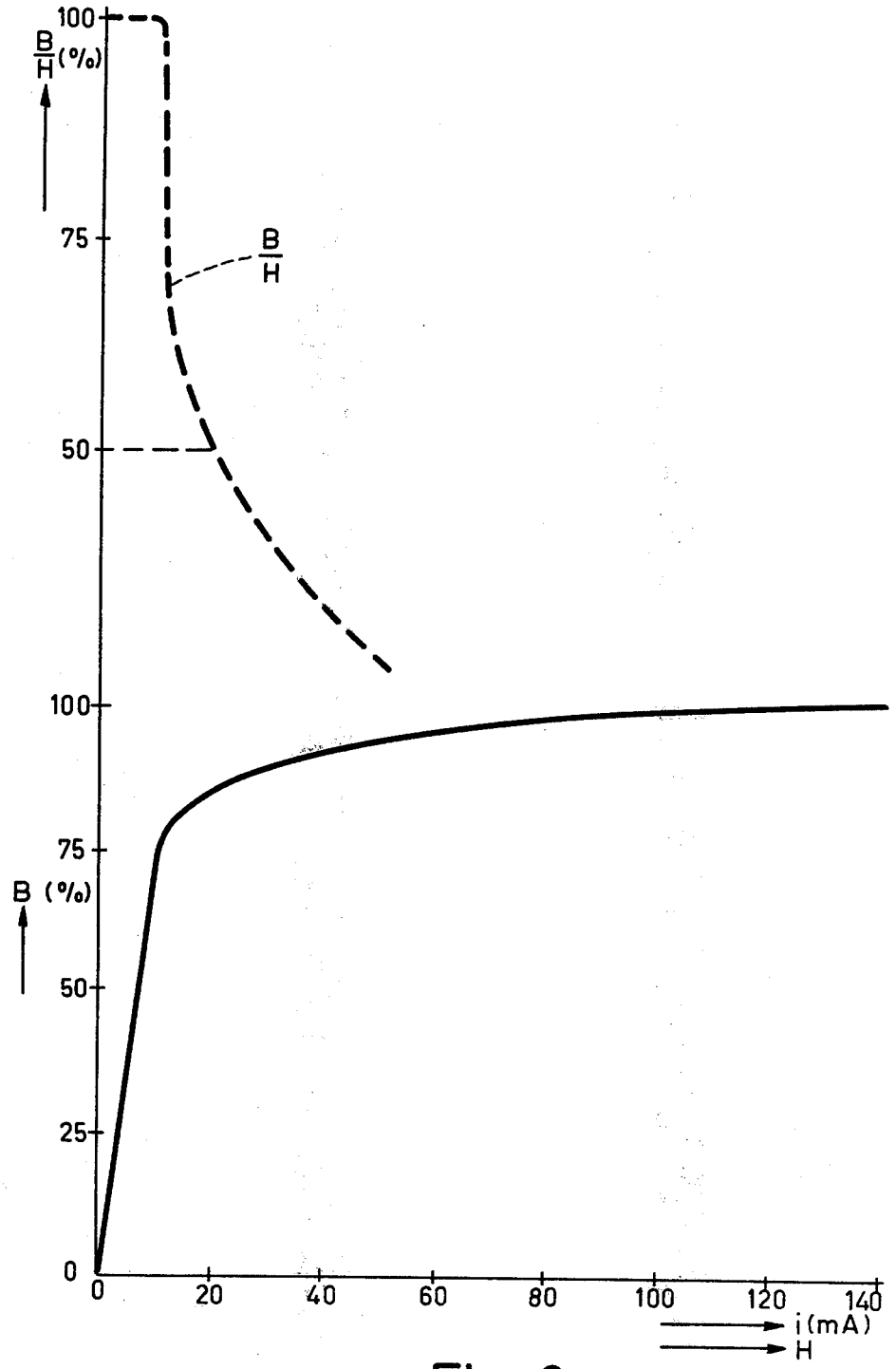
FIG. 3 shows the B-H curve of the second coil of the device of FIG. 1, as well as the ration B/H versus the instantaneous value of the current through the second coil

In a practical embodiment the capacitance of the capacitor 3 was approximately 3.7 $\mu$ Farad, the self-induction of the coil 4 approximately 1.5 Henry, the capacitance of the capacitor 15 approximately 47 kp Farad and that of capacitor 16 approximately 10 kp Farad. The B-H magnetization curve of the transformer 13 is shown in FIG. 3, namely by means of a solid line. The dashed line in that figure shows the ratio B/H versus the instantaneous current i through the second coil. B and B/H are expressed in percent. The dimensions of the second coil (transformer 13) are approximately 20 $\times$ 33 $\times$ 47 mm. At room temperature the resistor 11 has a resistive value of approximately 40 Ohm. If the lamps 5 and 6 do not start, the ohmic value of resistor 11 increases in about 5 seconds to a value of approximately 20 kOhm.

The circuit of FIG. 1 operates as follows. If the terminals 1 and 2 are connected to the 220 V, 50 Hz supply, an electrode preheating current first starts flowing in the circuit 1, 3, 4, 7, 11, 12, 10, 2. The value of this current is such that the auxiliary coil 12 becomes saturated. This causes a resonant condition so that a voltage of approximately 300 V is produced between the electrodes 7 and 10. If the preheating current has passed for some time through the outer electrodes 7 and 10 and if the remaining electrodes also have been preheated via the supply from the winding 14 of transformer 13, said voltage between electrodes 7 and 10 is sufficient to start both lamps 5 and 6. When the lamps 5 and 6 start the following happens. The voltage between the outer electrodes 7 and 10 drops to approximately 206 V. This voltage is so low that the auxiliary coil 12 is brought out of saturation and consequently assumes a high impedance value. However, the current strength in the auxiliary coil now shows a picture as indicate in FIG. 4. At the end of a half cycle the current strength through the auxiliary coil achieves a value at which that coil again becomes slightly saturated. The reduction in the impedance of the auxiliary coil thus obtained means that a larger current starts flowing through it which generates, across that coil and consequently across the lamps, a high voltage which facilitates restarting of those lamps. The capacitors 15 and 16 are used to provide a reliable sequential starting of the lamps when power is initially applied to terminals 1 and 2.

Figure 2:
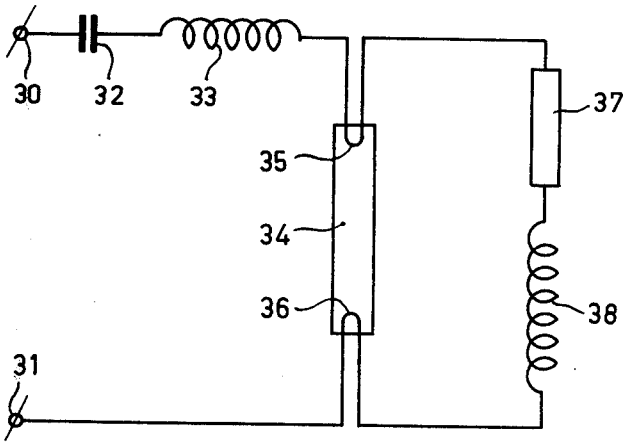
FIG. 2 shows a second electric device according to the invention which is provided with one discharge lamp.

In FIG. 2 references 30 and 31 designate two input terminals which are again intended for connection to a 220 V, 50 Herz a.c. supply circuit. Reference 32 is a capacitor and 33 a first coil. The circuit elements 32 and 33 are interconnected in series and connected to the terminal 30. At the other side of coil 33 there is a low-pressure mercury vapour discharge lamp of approximately 85 W, having an operating voltage of 178 Volt. This lamp is designated by reference numeral 34. The lamp 34 is provided with two preheatable electrodes 35 and 36. The electrode 36 is connected to the input terminal 31. The lamp 34 is shunted by a series circuit of a resistor 37 having a positive temperature coefficient and a second coil 38 which can be raised to saturation. The series circuit 37–38 is connected between those ends of the electrodes 35 and 36 which point away from the input terminals 30 and 31.

In an embodiment of the circuit of FIG. 2 the capacitance of capacitor 32 is approximately 4,5 $\mu$ Farad, the self-induction of coil 33 approximately 1 Henry, and in its unsaturated condition the second coil 38 has a self-induction of approximately 60 Henry. The resistor 37 is of the same type as resistor 11 of FIG. 1, namely a resistor having a positive temperature coefficient (P.T.C.-resistor).

The device of FIG. 2 operates in substantially the same way as that of FIG. 1, the difference being that now no intermediate electrodes need to be supplied. Also in the case of FIG. 2 the operation of coil 38 first facilitates preheating and, by means of resonance, the starting of lamp 34. Furthermore, the coil 38 assists in the restarting of said lamp by supplying a peak voltage at the ends of each half cycle in the operating condition of the lamp 34.

In FIG. 3 the magnetic induction B within the second coil and also B/H is plotted in percent on the vertical axis. The current strength through the second coil in milli-amperes is plotted on the horizontal axis. This is at the same time a measure of the magnetic field strength H. The magnetisation curve (B, H curve) is shown as a solid line. The B/H curve corresponding with it is represented by a dashed line. FIG. 3 shows that at approximately 20 m Amperes = 0.02 A the ratio B/H has dropped to 50% of its value in the fully unsaturated condition.

Figure 4:
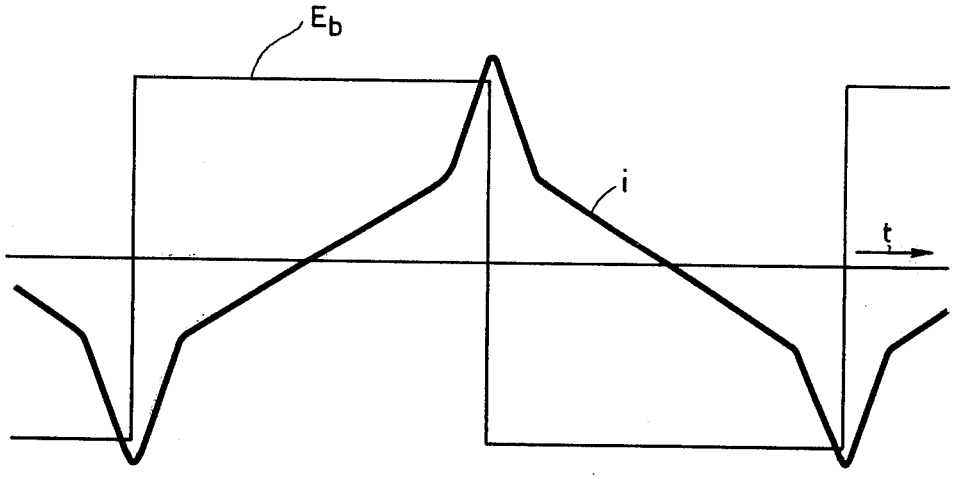
FIG. 4 is a diagrammatic representation of the voltage across — and the current through — the second coil of the device of FIG. 1.

*Eb* in FIG. 4 diagrammatically shows the voltage across the lamp versus the time *t*. Further, the curve *i* shows, also diagrammatically, the current through the second coil. It will be seen that this current undergoes a strong increase at the ends of a half cycle. This is caused by the fact that the second coil again becomes saturated. This results in a large voltage across the auxiliary coil, which voltage is also found across the lamp. This results in the operation which facilitates restarting of the lamp.

In the described device of FIG. 1 the ratio $$\frac{Eb}{2fL} = \frac{206}{2 \cdot 50 \cdot 64} = 0.032\ A.$$

The *i*-value = 0.02 A, at which the ratio B/H drops at an increasing H to its 50% value, is then indeed situated between $$0.5\ \frac{Eb}{2fL} = 0.016\ A$$

and $$\frac{Eb}{2fL} = 0.032\ A.$$

In the described device of FIG. 2 the ratio $$\frac{Eb}{2fL} = \frac{178}{2 \cdot 50 \cdot 60} = 0.03\ A.$$

As the B-H curve of the coil 38 only slightly deviates from that of transformer 13 in the example of FIG. 1, here too it applies that the *i*-value of approximately 0.02 A (see FIG. 3) at which the ratio B/H, at an increasing H, drops to its 50% value, is situated between $$0.5\ \frac{Eb}{2fL} = 0.015\ A$$

and $$\frac{Eb}{2fL} = 0.03\ A.$$

From the description it appears that in both embodiments the operating voltage of the lamp (lamps) of 178 V and 206 V respectively is only slightly below the value of the supply voltage (220 V).

What is claimed is:

1. An electric device for starting and operating at least one electric discharge lamp comprising, two input terminals adapted for connection to an a.c voltage source, means connecting a series circuit incuding at least two coils and a capacitor across said input terminals so that in the operating condition of the device the capacitor and one of the coils are connected in series with the lamp and the second coil is in parallel with the lamp, the second coil being chosen so that with the AC voltage applied to the device but with the lamp not yet started said second coil becomes saturated, a resonant condition occuring at said saturation so that the voltage across the non-started lamp exceeds the voltage of the a.c. voltage source and ignites the lamp, the second coil on starting of the lamp being brought out of saturation and consequently assuming an impedance value which exceeds the resistance of the started lamp, characterized in that the second coil has a B-H magnetisation curve such that for an increasing H the ratio B/H drops to its 50% value at an instantaneous current *i* through the second coil which satisfies the expression:

$$0.5 \cdot \frac{Eb}{2fL} < i < \frac{Eb}{2fL}$$

where:

H is the magnetic field strength within the second coil;

B is the magnetic induction within the second coil;

$i$ is the instantaneous electric current through the second coil (in Amperes);

E$b$ is the r.m.s. voltage across the started lamp (in Volts);

$f$ is the frequency of the a.c. supply voltage (in Herz); and $L$ is the average self-induction of the second coil in its unsaturated condition.

2. An electric device as claimed in claim 1, wherein the branch containing the second coil and connected in parallel to the lamp includes a positive temperature coefficient resistor connected in series with the second coil.

3. An electric device as claimed in claim 1 wherein the lamp comprises one low-pressure mercury vapor discharge lamp provided with preheatable electrodes, characterized in that the second coil is connected between the ends of each of the lamp electrodes which are remote from the input terminals.

4. An electric device as claimed in claim 3, for connection to an a.c. voltage source of approximately 220 V r.m.s., 50 Herz, the power of the lamp being approximately 85 Watts and its operating voltage being between 170 and 190 V, characterized in that the self-induction of the first coil is approximately 1 Henry, the capacitance of the capacitor approximately 4.5 $\mu$ Farad and the average self-induction of the unsaturated second coil approximately 60 Henry.

5. An electric device as claimed in claim 1 for starting and supplying two or more series-connected discharge lamps provided with preheatable electrodes, characterized in that the second coil comprises the primary winding and a saturable core of a transformer, the primary winding being connected to the outer electrodes of the series arrangement of lamps betwen the electrode-ends which are remote from the input terminals, the remaining lamp electrodes being connected to at least one secondary winding of the transformer.

6. An electric device as claimed in claim 5 for connection to an a.c. voltage source of approximately 220 V r.m.s. and 50 Herz for starting and supplying a series arrangement of two low-pressure mercury vapour discharge lamps of about 40 Watt each, each having an operating voltage of approximately 100 V, characterized in that the self-induction of the first coil is approximately 1.5 Henry, the capacitance of the capacitor approximately 3.5 $\mu$ Farad and the average self-induction of the loaded unsaturated transformer approximately 64 Henry.

7. A supply circuit for an electric discharge lamp comprising, a pair of input terminals for applying an AC supply voltage to the lamp, a first coil, a capacitor, a second saturable coil, means connecting the first coil and the capacitor in series with the lamp across the input terminals, means connecting the second coil in parallel with the lamp, said second coil being chosen so that with an AC voltage applied to the input terminals but with the discharge lamp not yet ignited the second coil becomes saturated whereby a resonant condition occurs to increase the voltage across the lamp thereby to ignite said lamp, the second coil during operation of the lamp being brought out of saturation for a major part of each half cycle of the AC supply voltage to exhibit a higher impedance and becoming saturated at the ends of each half cycle of said AC supply voltage to produce voltage peaks for restarting the lamp.

8. A supply circuit as claimed in claim 7 wherein the lamp includes preheatable electrodes connected to the second coil so that prior to ignition of the lamp a preheat current flows through a circuit including the first coil, the capacitor, the lamp electrodes and the second coil.

9. A supply circuit as claimed in claim 7 further comprising a positive temperature coefficient resistor connected in series with the second coil in a branch that is in parallel with the discharge lamp.

10. A supply circuit as claimed in claim 7 wherein said first coil and capacitor exhibit a net capacitive impedance at the frequency of the AC supply voltage and the second coil has a B-H magnetization curve wherein as H is increased the ratio B/H drops to 50% of its value in the unsaturated condition at a current value $I$ through the second coil which satisifies the expression:

$$0.5 \frac{(Eb)}{2fL} < I < \frac{Eb}{2fL}$$

where:

H is the magnetic field strength with the second coil;

B is the magnetic induction within the second coil;

I is the current in the second coil in amperes;

$E_b$ is the effective voltage across the ignited lamp in volts;

$f$ is the frequency of the AC supply voltage in $H_z$; and $L$ is the average self-inductance of the unsaturated second coil.

11. A supply circuit for an electric discharge lamp comprising, a pair of input terminals for applying an AC supply voltage to the lamp, a first coil, a capacitor, a second saturable coil, means connecting the first coil and the capacitor in series with the lamp across the input terminals, means connecting the second coil in parallel with the lamp, said second coil being chosen so that during operation of the lamp the second coil is brought into saturation and out of saturation during each half cycle of the AC supply voltage, and the second coil has a B-H magnetization curve wherein as H is increased the ratio B/H drops to 50% of its value in the unsaturated condition at a current value $I$ through the second coil which satisfies the expression:

$$0.5 \frac{(Eb)}{2fL} < I < \frac{Eb}{2fL}$$

where:

H is the magnetic field strength within the second coil;

B is the magnetic induction within the second coil;

$I$ is the current in the second coil in amperes;

$E_b$ is the effective voltage across the ignited lamp in volts;

$f$ is the frequency of the AC supply voltage in $H_z$; and $L$ is the average self-inductance of the unsaturated second coil.

12. A supply circuit as claimed in claim 11 wherein, with an AC voltage applied to the input terminals but with the discharge lamp not yet ignited the second coil becomes saturated whereby the second coil becomes resonant with the capacitor to increase the voltage across the lamp thereby to ignite said lamp.

13. A supply circuit as claimed in claim 11 further comprising a positive temperature coefficient resistor connected in series with the second coil in a branch that is in parallel with the discharge lamp.

* * * * *

UNITED STATES PATENT AND TRADEMARK OFFICE

CERTIFICATE OF CORRECTION

PATENT NO. : 4,017,761

DATED : April 12, 1977

INVENTOR(S) : LEONARD WOLDRING

It is certified that error appears in the above-identified patent and that said Letters Patent are hereby corrected as shown below:

Col. 1, line 32, "taht" should be --that--;

line 44, "shuts" should be --shunts--;

line 68, after "expression" should be --:-- (colon)

Col. 2, line 23, "phase" should be --phrase--;

Col. 3, line 38, "4,7" should be --4.7--;

Col. 4, line 5, "ration" should be --ratio--;

Col. 5, line 32, "4,5μ" should be --4.5μ--.

UNITED STATES PATENT AND TRADEMARK OFFICE

CERTIFICATE OF CORRECTION

PATENT NO. : 4,017,761

DATED : April 12, 1977

INVENTOR(S) : LEONARD WOLDRING

It is certified that error appears in the above-identified patent and that said Letters Patent are hereby corrected as shown below:

PAGE II OF II

Claim 6, line 9, "3.5μ" should be --3.7μ--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*